US007059415B2

(12) United States Patent
Bosma et al.

(10) Patent No.: US 7,059,415 B2
(45) Date of Patent: Jun. 13, 2006

(54) WELLBORE SYSTEM WITH ANNULAR SEAL MEMBER

(75) Inventors: Martin Gerard Rene Bosma, Rijswijk (NL); Erik Kerst Cornelissen, Rijswijk (NL)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 10/484,221

(22) PCT Filed: Jul. 18, 2002

(86) PCT No.: PCT/EP02/08046

§ 371 (c)(1),
(2), (4) Date: Aug. 23, 2004

(87) PCT Pub. No.: WO03/008756

PCT Pub. Date: Jan. 30, 2003

(65) Prior Publication Data

US 2004/0261990 A1 Dec. 30, 2004

(30) Foreign Application Priority Data

Jul. 18, 2001 (EP) ..... 01306178

(51) Int. Cl.
*E21B 33/12* (2006.01)
*E21B 43/14* (2006.01)

(52) U.S. Cl. ..... 166/313; 166/50; 166/179; 166/191; 166/207

(58) Field of Classification Search ..... 166/179, 166/191, 50, 313, 206, 207
See application file for complete search history.

(56) References Cited

U.S. PATENT DOCUMENTS 2,103,482 A 12/1937 McCandless ..... 73/242
2,945,541 A * 7/1960 Maly et al. ..... 166/185
3,067,819 A * 12/1962 Gore ..... 166/387
3,170,516 A 2/1965 Holland et al. ..... 166/23
3,179,168 A 4/1965 Vincent ..... 166/14
3,297,092 A 1/1967 Jennings ..... 166/207
3,312,296 A 4/1967 Paramore et al. ..... 175/72

(Continued)

FOREIGN PATENT DOCUMENTS

CA 1247252 12/1988

(Continued)

OTHER PUBLICATIONS

Design Approach to Sealant Selection for the Life of the Well, 1999, SPE 56536, Martin Bosma, et al. p. 283-296.

(Continued)

*Primary Examiner*—Hoang Dang
(74) *Attorney, Agent, or Firm*—Rachael A. Stiegel

(57) ABSTRACT

A wellbore system having a borehole extending into an earth formation, a tubular element extending into the borehole whereby a cylindrical wall surrounds the tubular element in a manner that an annular space is formed between the tubular element and the cylindrical wall, at least one seal member arranged in the annular space, each seal member being movable between a retracted mode in which the seal member has a first volume and an expanded mode in which the seal member has a second volume larger than the first volume, wherein the seal member in the expanded mode thereof seals the annular space, and wherein the seal member includes a material which swells upon contact with a selected fluid so as to move the seal member from the retracted mode to the expanded mode thereof.

14 Claims, 3 Drawing Sheets

U.S. PATENT DOCUMENTS

| | | | | |
|---|---|---|---|---|
| 3,933,204 | A | 1/1976 | Knapp | 166/295 |
| 3,960,801 | A | 6/1976 | Cole et al. | 260/33.6 |
| 4,216,829 | A | 8/1980 | Murphey | 166/276 |
| 4,366,284 | A | 12/1982 | Ishido et al. | |
| 4,443,019 | A | 4/1984 | Ishido et al. | |
| 4,537,918 | A | 8/1985 | Parcevaus et al. | 523/130 |
| 4,558,875 | A | 12/1985 | Yamaji et al. | |
| 4,590,227 | A | 5/1986 | Nakamura et al. | |
| 4,716,965 | A | 1/1988 | Bol et al. | 166/292 |
| 4,740,404 | A | 4/1988 | Otsugu et al. | |
| 4,797,159 | A | 1/1989 | Spangle | 106/89 |
| 4,898,242 | A | 2/1990 | Jennings, Jr. et al. | 166/285 |
| 4,921,047 | A | 5/1990 | Summers et al. | 166/276 |
| 5,011,875 | A | 4/1991 | Yamamoto et al. | |
| 5,048,605 | A | 9/1991 | Toon et al. | |
| 5,159,980 | A | 11/1992 | Onan et al. | 166/294 |
| 5,195,583 | A | 3/1993 | Toon et al. | |
| 5,215,147 | A | 6/1993 | Grego et al. | 166/270 |
| 5,290,844 | A | 3/1994 | Otsuka | |
| 5,293,938 | A | 3/1994 | Onan et al. | 166/293 |
| 5,310,846 | A | 5/1994 | Inomata et al. | 528/24 |
| 5,314,023 | A | 5/1994 | Dartez et al. | 166/295 |
| 5,342,879 | A | 8/1994 | Takahashi et al. | 524/588 |
| 5,366,012 | A | 11/1994 | Lohbeck | |
| 5,484,020 | A | 1/1996 | Cowan | 166/295 |
| 5,497,829 | A | 3/1996 | Rajkovich | 166/285 |
| 5,706,896 | A * | 1/1998 | Tubel et al. | 166/313 |
| 5,712,314 | A | 1/1998 | Surles et al. | 521/41 |
| 5,738,463 | A | 4/1998 | Onan | 405/154 |
| 5,794,702 | A | 8/1998 | Nobileau | 166/380 |
| 5,833,001 | A | 11/1998 | Song et al. | 166/287 |
| 5,875,844 | A | 3/1999 | Chatterji et al. | 166/293 |
| 5,875,845 | A | 3/1999 | Chatterji et al. | 166/293 |
| 5,901,789 | A | 5/1999 | Donnelly et al. | |
| 5,969,006 | A | 10/1999 | Onan et al. | 523/166 |
| 6,006,834 | A | 12/1999 | Skinner | 166/250.17 |
| 6,012,524 | A | 1/2000 | Chatterji et al. | 166/295 |
| 6,581,682 | B1 * | 6/2003 | Parent et al. | 166/180 |
| 6,848,505 | B1 * | 2/2005 | Richard et al. | 166/285 |
| 2002/0145281 | A1 * | 10/2002 | Metcalfe et al. | 285/206 |
| 2004/0123983 | A1 * | 7/2004 | Cook et al. | 166/50 |
| 2004/0144538 | A1 * | 7/2004 | Richard et al. | 166/294 |
| 2004/0194971 | A1 * | 10/2004 | Thomson | 166/387 |

FOREIGN PATENT DOCUMENTS

| | | |
|---|---|---|
| CA | 1247352 | 12/1988 |
| CA | 1324753 | 11/1993 |
| EP | 0325541 | 7/1989 |
| EP | 0899417 | 3/1999 |
| RU | 2103482 | 1/1998 |
| WO | 94/21886 | 9/1994 |
| WO | 99/02818 | 1/1999 |
| WO | 99/06670 | 2/1999 |
| WO | 99/43923 | 9/1999 |
| WO | 00/61914 | 10/2000 |

OTHER PUBLICATIONS

Determining Petrophysical Parameters of Rock during Phase Displacement with CT Technique, Zhongyuan Tian, et al, 2000 SPE 64768, pp. 1-9.

Phenolic/Epoxy Resins for Water/Gas Profile Modification & Casing Leak Repair, 6th ADIPEC, Oct. 16-19, 1994, Rick C. Ng, et al, pp. 219-232.

Fred W. Billmeyer, Jr., "Textbook of Polymer Science", 3rd Ed., Wiley-Interscience Pub., pp. 375-376.

Werner Hofmann, "Rubber Technology Handbook", Hanser Pub., pp. 74-75, 184-185.

* cited by examiner

WELLBORE SYSTEM WITH ANNULAR SEAL MEMBER

FIELD OF THE INVENTION

The present invention relates to a wellbore system comprising a borehole extending into an earth formation, a tubular element extending into the borehole whereby a cylindrical wall surrounds the tubular element in a manner that an annular space is formed between the tubular element and the cylindrical wall, and wherein at least one seal member is arranged in said annular space. The cylindrical wall can be formed, for example, by the borehole wall or by another tubular element.

BACKGROUND OF THE INVENTION

Known seal members are, for example, packers which are arranged in the borehole to seal an annular space between a wellbore casing and a production tubing extending into the borehole. Such packer is radially deformable between a retracted position in which the packer is lowered into the borehole, and an expanded position in which the packer forms a seal. Activation of the packer can be by mechanical or hydraulic means. A limitation of the applicability of such packers is that the seal surfaces have to be well defined.

Another type of annular seal member is formed by a layer of cement arranged in an annular space between a wellbore casing and the borehole wall. Although in general cement provides adequate sealing capability, there are some inherent drawbacks such as shrinking of the cement during hardening resulting in de-bonding of the cement sheath, or cracking of the cement layer after hardening, for example due to pressure and temperature shocks during operation of the well.

In view thereof there is a need for an improved wellbore system which provides adequate sealing of the annular space formed between a tubular element extending into the borehole and a cylindrical wall surrounding the tubular element.

SUMMARY OF THE INVENTION

In accordance with the invention there is provided a wellbore system comprising a borehole extending into an earth formation, a tubular element extending into the borehole whereby a cylindrical wall surrounds the tubular element in a manner that an annular space is formed between the tubular element and the cylindrical wall, at least one seal member arranged in said annular space, each seal member being movable between a retracted mode in which the seal member has a first volume and an expanded mode in which the seal member has a second volume larger than the first volume, wherein the seal member in the expanded mode thereof seals the annular space, and wherein the seal member includes a material which swells upon contact with a selected fluid so as to move the seal member from the retracted mode to the expanded mode thereof.

By bringing the seal member into contact with the selected fluid, the seal member swells and thereby becomes firmly pressed between the tubular element and the cylindrical wall. As a result the annular space becomes adequately sealed, even if one or both of the tubular element and the cylindrical wall are of irregular shape.

Suitably the cylindrical wall is one of the borehole wall and the wall of a casing extending into the borehole.

The system of the invention can also be used in applications wherein the cylindrical wall-is the wall of an outer casing arranged in the borehole, and wherein the tubular element is an inner casing, tubing or liner arranged in the borehole and extending at least partly into the outer casing.

To obtain an even better sealing system, it is preferred that the tubular element has been radially expanded in the borehole. In such application the seal member can be, for example, applied to the outer surface of the tubular element before radial expansion thereof so as to allow easy installation of the tubular element and the seal member in the borehole. Thereafter the tubular element can be radially expanded before or after swelling of the seal member due to contact with the selected fluid. However, to reduce the forces needed to expand the tubular element it is preferred that swelling of the seal member takes place after expansion of the tubular element.

Suitably the selected fluid is water or hydrocarbon fluid contained in the earth formation.

It is preferred that said material of the seal member includes one of a rubber compound, a thermoset compound and a thermoplastic compound. The rubber compound is suitably selected from a thermoset rubber compound and a thermoplastic rubber compound.

Examples of suitable thermoset rubbers, which swell when in contact with oil are:

natural rubber, nitrile rubber, hydrogenated nitrile rubber, acrylate butadiene rubber, poly acrylate rubber, butyl rubber, brominated butyl rubber, chlorinated butyl rubber, chlorinated polyethylene, neoprene rubber, styrene butadiene copolymer rubber, sulphonated polyethylene, ethylene acrylate rubber, epichlorohydrin ethylene oxide copolymer, ethylene-propylene-copolymer (peroxide cross-linked), ethylene-propylene-copolymer (sulphur cross-linked), ethylene-propylene-diene terpolymer rubber, ethylene vinyl acetate copolymer, fluoro rubbers, fluoro silicone rubber, and silicone rubbers.

A review of thermoset and thermoplastic rubbers and their ability to swell in certain fluids such as hydrocarbon oils can be found in standard reference books such as 'Rubber Technology Handbook', authored by Werner Hofmann (ISBN 3-446-14895-7, Hanser Verlag Muenchen), Chapters 2 and 3. Preferably, one would select rubbers which swell substantially (at least 50 vol %) in hydrocarbons at typical conditions of temperature and pressure as encountered in oil or gas wells, but yet remain integer in a swollen state for enhanced periods of times (i.e. years). Examples of such rubbers are ethylene-propylene-copolymer (peroxide cross-linked) also known as EPDM rubber, ethylene-propylene-copolymer (sulphur cross-linked) also known as EPDM rubber, ethylene-propylene-diene terpolymer rubber also known as EPT rubber, butyl rubber, brominated butyl rubber, chlorinated butyl rubber, and chlorinated polyethylene.

Examples of suitable materials which swell when in contact with water are: starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers and the like and highly swelling clay minerals such as Sodium Bentonite (having as main ingredient montmorillonite).

Suitable recipes are for instance disclosed in U.S. Pat. No. 5,011,875 (Corrosion Resistant Water Expandable Composition), U.S. Pat. No. 5,290,844 (Water Swelleable Water Stop), U.S. Pat. No. 4,590,227 (Water-Swelleable Elastomer Composition), U.S. Pat. No. 4,740,404 (Waterstop), U.S. Pat. Nos. 4,366,284, 4,443,019 and 4,558,875 (all entitled: 'Aqueously-Swelling Water Stopper and a Process of Stopping Water thereby'). The water swelling elastomer compositions are commonly referred to as 'Waterstops' and are commercially available under trade names such as HYDROTITE and SWELLSTOP.

BRIEF DESCRIPTION OF THE DRAWINGS

The invention will be described hereinafter in more detail and by way of example with reference to the accompanying drawings in which FIG. 1 schematically shows an embodiment of the wellbore system of the invention.

DETAILED DESCRIPTION OF THE INVENTION

Figure 1:
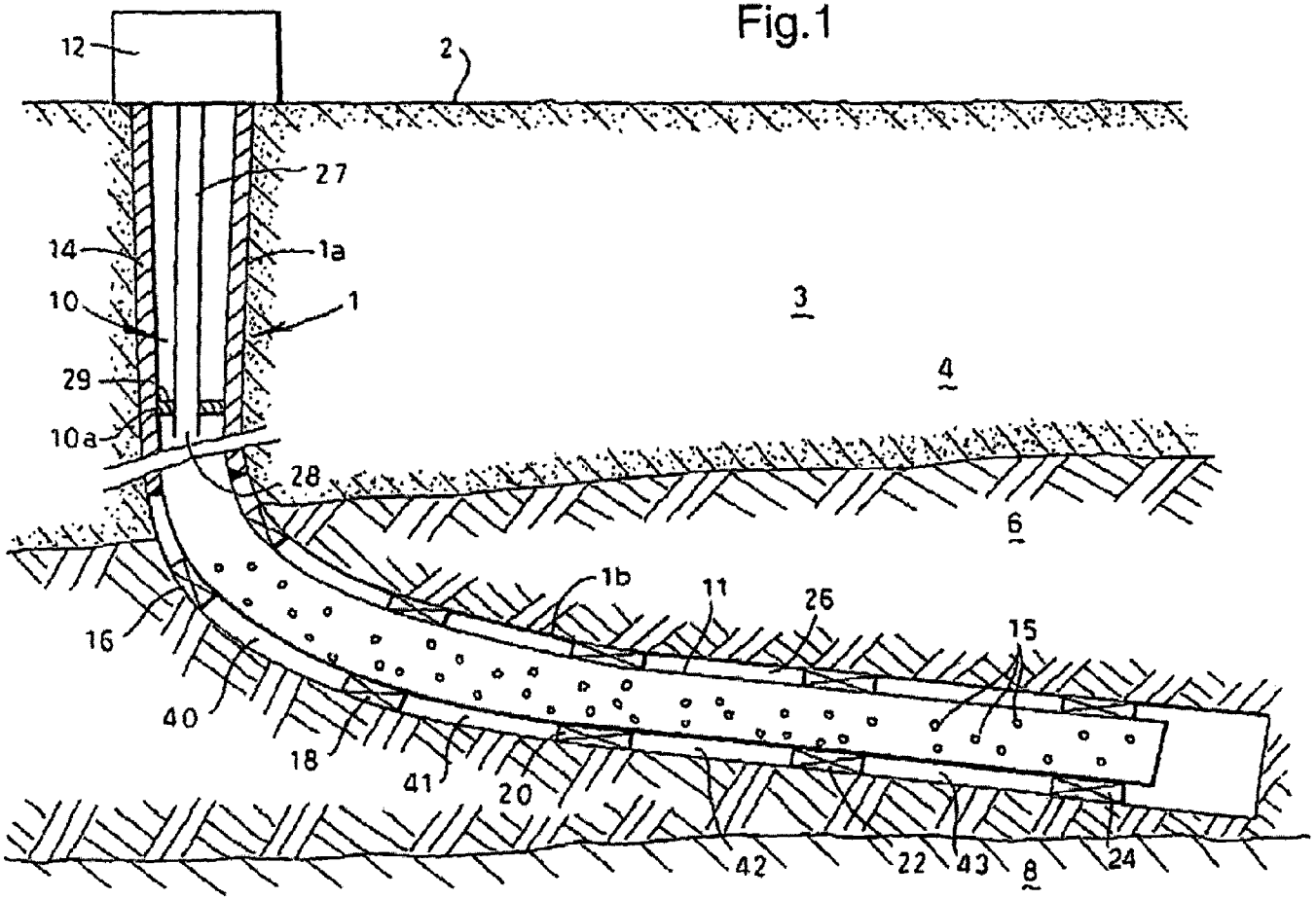

Referring to FIG. 1 there is shown a wellbore system including a borehole 1 which has been drilled from surface 2 into an earth formation 3. The borehole 1 penetrates an overburden layer 4 and a reservoir zone 6 containing hydrocarbon oil. A layer 8 containing formation water is commonly found below the reservoir zone. The borehole 1 has a substantially vertical upper section 1*a* extending through the overburden layer 4 and a substantially horizontal lower section 1*b* extending into the reservoir zone 6.

A tubular casing string 10 which is formed of a number of casing sections (not shown), extends from a wellhead 12 at surface into the upper borehole section 1*a*. A further tubular casing string 11 is provided with a plurality of perforations 15 (for sake of clarity not all perforations have been indicated by a reference numeral) which provide fluid communication between the interior of the casing string 11 and the exterior thereof. Annular seal assemblies 16, 18, 20, 22, 24 are arranged at selected mutual spacings in an annular space formed 26 formed between the lower casing string 11 and the wall of the lower borehole section 1*b*. Furthermore, a production tubing 27 extends from the wellhead 12 into the vertical borehole section 1*a* to a position at or near the transition from the vertical borehole section 1*a* to the horizontal borehole section 1*b*. The tubing 27 has an open lower end 28, and is provided with a seal packer 29 which seals the annular space between the tubing 27 and the casing string 10.

Figure 2:
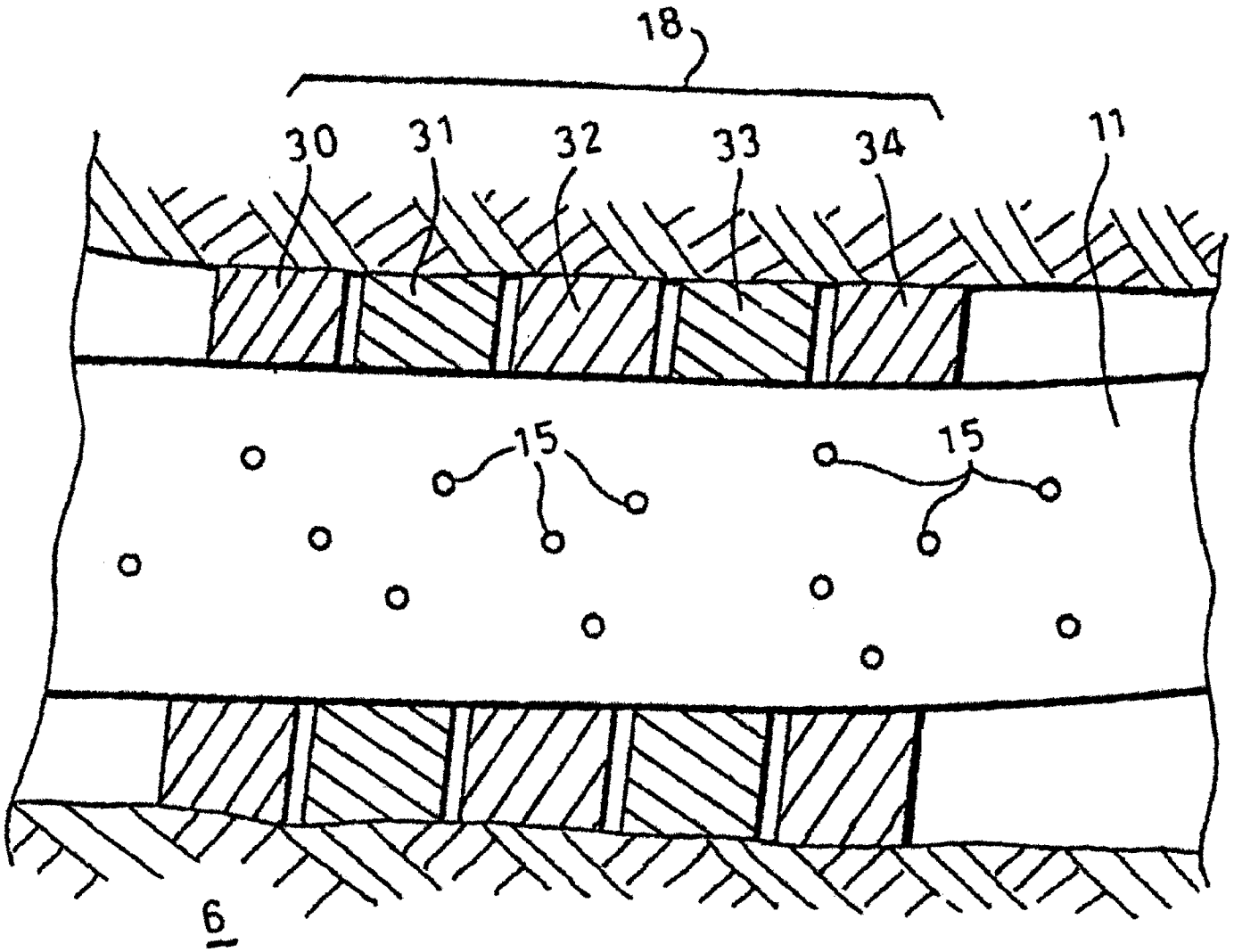
FIG. 2 schematically shows a detail of FIG. 1.
Figure 3:
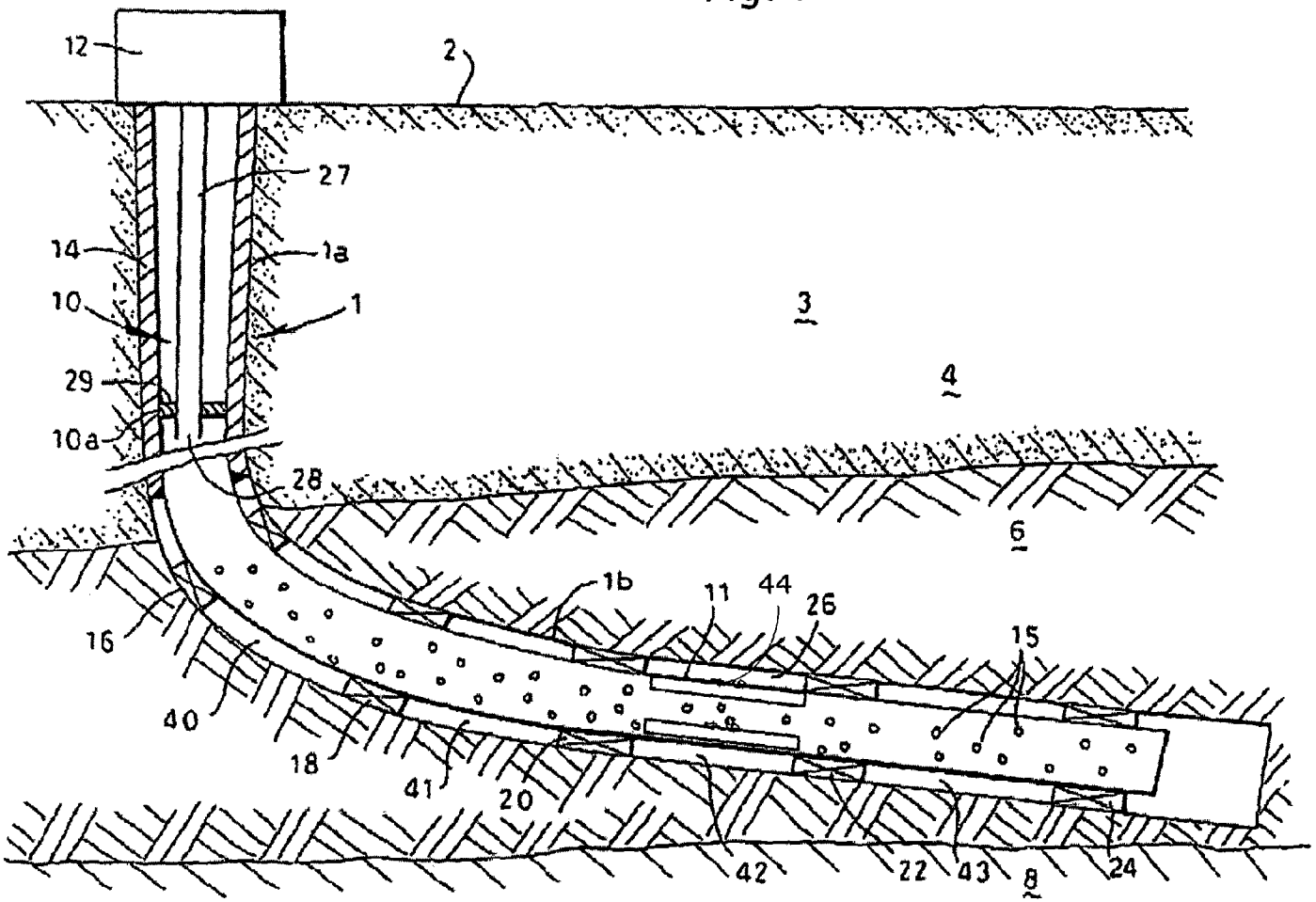
FIG. 3. shows the wellbore system of FIG. 1 with a tubular patch.

Referring further to FIG. 2 there is shown seal assembly 18 in more detail, the other annular seal assemblies being similar thereto. Annular seal assembly 18 includes individual seal members 30, 31, 32, 33, 34, each seal member being movable between a retracted mode in which the seal member has a first volume and an expanded mode in which the seal member has a second volume larger than the first volume, whereby the seal member in the expanded mode thereof seals the annular space 26. Seal members 30, 32, 34 are made of a material which swells upon contact with a hydrocarbon oil so as to move the seal member 30, 32, 34 from the retracted mode to the expanded mode thereof. Seal members 31, 33 are made of a material which swells upon contact with water so as to move the seal member 31, 33 from the retracted mode to the expanded mode thereof. A suitable material for seal members 30, 32, 34 is, for example, EPDM rubber (ethylene-propylene-copolymer, either sulphur or peroxide cross-linked), EPT rubber (ethylene-propylene-diene terpolymer rubber), butyl rubber or a halogenated butyl rubber. A suitable material for seal members 31, 33 is for example a thermoset or thermoplast rubber filled with a substantial (60%) quantity of a water swelleable agent e.g. bentonite, but any of the 'WaterStop' formulations cited above, could be used.

During normal use, the vertical borehole section 1*a* is drilled and the casing sections of casing string 10 are installed therein as drilling proceeds. Each casing section is radially expanded in the vertical borehole section 1*a* and conventionally cemented therein by means of layer of cement 14. Subsequently the horizontal borehole section 1*b* is drilled and lower casing string 11 is installed therein. Before lowering the lower casing string 11 into the borehole 1, the annular seal assemblies 16, 18, 20, 22, 24 are arranged around the outer surface of the lower casing string 11 at the indicated mutual spacings, whereby each individual seal member 30, 31, 32, 33, 34 of the seal assemblies is in its retracted mode. After installing the lower casing string 11 into the lower borehole section 1*b*, the lower casing string 11 is radially expanded to a diameter larger than before such that the seal assemblies 16, 18, 20, 22, 24 are not, or only loosely, in contact with the borehole wall.

When production of hydrocarbon oil starts, a valve (not shown) at the wellhead 12 is opened and hydrocarbon oil flows from the reservoir zone 6 into the lower borehole section 1*b*. The oil flows via the perforations 15 into the lower casing string 11 and from there via the production tubing to the wellhead 12 where the oil is further transported through a pipeline (not shown) to a suitable production facility (not shown).

As the oil flows into the lower borehole section 1*b*, the oil comes into contact with the individual seal members of each seal assembly 16, 18, 20, 22, 24. The seal members 30, 32, 34 thereby swell and, as a result, move to the expanded mode so as to become firmly pressed between the lower casing part 10*b* and the borehole wall. In this manner each seal assembly seals the annular space 26 and divides the horizontal borehole section 1*b* into respective borehole zones 40, 41, 42, 43 whereby zone 40 is defined between seal assemblies 16 and 18, zone 41 is defined between seal assemblies 18 and 20, zone 42 is defined between seal assemblies 20 and 22, and zone 43 is defined between seal assemblies 22 and 24.

After some time it can occur that water from the formation layer 8 enters the horizontal borehole section 1*b*, for example due to the well-known phenomenon of water coning. To determine the zone of the borehole section 1*b* where the water flows into the borehole a suitable production logging tool is lowered into the lower casing string 11 and operated. Once the zone of water entry has been determined, for example zone 42, a patch is installed in the lower casing string 11, between seal assemblies 20, 22, so as to close-off the perforations 15 located between seal assemblies 20, 22. A suitable patch is, for example, a length of tube 44 which is radially expanded against the inner surface of lower casing string 11. The patch can be clad with a water swelling gasket.

Should the seal members 30, 32, 34 of respective seal assemblies 20, 22 move to their retracted mode due to discontinued contact with hydrocarbon oil, the presence of water in zone 42 ensures that the seal members 31, 33 of seal assemblies 20, 22 swell and thereby move to the expanded mode. It is thus achieved that at least some of the seal members 30, 31, 32, 33, 34 of seal assemblies 20, 22 seal the annular space 26, irrespective whether oil or water is the surrounding medium.

In an alternative embodiment of the system of the invention, an expandable slotted tubular (EST) (EST is a trademark) liner can be applied instead of the perforated lower casing string 11 referred to above. For example, a liner with overlapping longitudinal slots as described in U.S. Pat. No. 5,366,012, could be applied. During radial expansion of the liner, the metal liner parts in-between the slots behave as plastic hinges so that the slots widen and thereby provide fluid communication between the interior of the liner and the exterior thereof. To isolate selected zones of the borehole from other zones, one or more patches in the form of blank casing sections can be expanded against the inner surface of the slotted liner. Such blank casing sections are suitably clad with alternating annular seal members of water and hydrocarbon swelling elastomers. In this way it is possible to shut off certain slotted sections of the liner which have watered out in the course of the life of the well.

In another alternative embodiment of the system of the invention, an expandable sand screen (ESS) (ESS is a trademark), such as described in U.S. Pat. No. 5,901,789, can be applied instead of the perforated lower casing string 11 referred to above. Again, patches in the form of blank casing sections (preferably clad with hydrocarbon- and/or water-swelleable gaskets) can be expanded against the inner surface of the expandable sand screen to isolate selected zones. Especially in very long parts of horizontal or multi-branch wells, certain sections of the sand screen, which would start producing water ('watered-out') and/or high ratios of gas ('gassed-out') can be isolated in this manner. If no corrective measures would be taken against such undesirable water or gas production, the well would very rapidly become uneconomical and its ultimate hydrocarbon fluid recovery would be significantly reduced.

The ability to shut off watered-out or gassed-out zones of the wellbore allows the Production Engineer to significantly defer the abandonment timing of the well and to maximise the ultimate recovery of the well.

Instead of applying the material which swells upon contact with hydrocarbon fluid and the material which swells upon contact with water in separate seal members, such material can be applied in a single seal member. For example, the hydrocarbon swelling ability of an EP(D)M or EPT rubber can be combined with a water swelling ability of a suitable filler such as e.g. bentonite in a single seal member, such that only one type of packing element with dual functionality is achieved.

While the illustrative embodiments of the invention have been described with particularity, it will be understood that various other modifications will be readily apparent to, and can be easily made by one skilled in the art without departing from the spirit of the invention. Accordingly, it is not intended that the scope of the following claims be limited to the examples and descriptions set forth herein but rather that the claims be construed as encompassing all features which would be treated as equivalents thereof by those skilled in the art to which this invention pertains.

We claim:

1. A wellbore system, comprising:

a borehole extending into an earth formation;

a tubular element extending into the borehole whereby a cylindrical wall surrounds the tubular element in a manner that an annular space is formed between the tubular element and the cylindrical wall; and at least one seal member arranged in said annular space, each seal member being movable between a retracted mode in which the seal member has a first volume and an expanded mode in which the seal member has a second volume larger than the first volume, wherein the seal member in the expanded mode thereof seals the annular space, and wherein the seal member includes a material, which swells upon contact with hydrocarbon fluid and a material, which swells upon contact with water so as to move the seal member from the retracted mode to the expanded mode thereof.

2. The wellbore system of claim 1, wherein the cylindrical wall is one of the borehole wall and the wall of a casing extending into the borehole.

3. The wellbore system of claim 1, wherein the tubular element is one of a perforated casing or liner, an expandable slotted tubular, and an expandable sand screen.

4. The wellbore system of claim 1, wherein the cylindrical wall is the wall of an outer casing arranged in the borehole, and wherein the tubular element is an inner casing arranged in the borehole and extending at least partly into the outer casing.

5. The wellbore system of claim 1, wherein a plurality of said seal members is arranged at selected mutual spacings in said annular space, and wherein each section of the tubular element in-between adjacent seal members is provided with at least one opening providing fluid communication between the interior of the tubular element and the earth formation surrounding the borehole.

6. The wellbore system of claim 5, wherein the borehole includes a substantially horizontal section, and wherein said plurality of seal members is arranged in the substantially horizontal section.

7. The wellbore system of claim 5, wherein at least one section of the tubular element in-between adjacent seal members is provided with closing means for closing each said opening of the tubular element.

8. The wellbore system of claim 7, wherein said closing means includes a tube arranged in said at least one section of the tubular element, which tube has been radially expanded against the inner surface of tubular element.

9. The wellbore system of claim 1, wherein said material of the seal member includes one of a thermoplastic rubber compound and a thermoset rubber compound.

10. The wellbore system of claim 1, wherein said material of the seal member swells upon contact with hydrocarbon fluid, and is selected from natural rubber, nitrile rubber, hydrogenated nitrile rubber, acrylate butadiene rubber, poly acrylate rubber, butyl rubber, brominated butyl rubber, chlorinated butyl rubber, chlorinated polyethylene, neoprene rubber, styrene butadiene copolymer rubber, sulphonated polyethylene, ethylene acrylate rubber, epichlorohydrin ethylene oxide copolymer, ethylene-propylene-copolymer (peroxide cross-linked), ethylene-propylene-copolymer (sulphur cross-linked), ethylene-propylene-diene terpolymer rubber, ethylene vinyl acetate copolymer, fluoro rubbers, fluoro silicone rubber, and silicone rubbers.

11. The wellbore system of claim 10, wherein said material is selected from EP(D)M rubber (ethylene-propylene-copolymer, either peroxide or sulphur cross-linked), EPT rubber (ethylene-propylene-diene terpolymer rubber), butyl rubber, brominated butyl rubber, chlorinated butyl rubber, and chlorinated polyethylene.

12. The wellbore system of claim 1, wherein said material of the seal member swells upon contact with water, and is selected from starch-polyacrylate acid graft copolymer, polyvinyl alcohol cyclic acid anhydride graft copolymer, isobutylene maleic anhydride, acrylic acid type polymers, vinylacetate-acrylate copolymer, polyethylene oxide polymers, carboxymethyl cellulose type polymers, starch-polyacrylonitrile graft copolymers and the like and highly swelling clay minerals such as Sodium Bentonite (having as main ingredient montmorillonite).

13. The wellbore system of claim 1, wherein each seal member forms part of a seal assembly which includes at least one other seal member, wherein the seal member includes a material which swells upon contact with hydrocarbon fluid so as to move the seal member from the retracted mode to the expanded mode thereof, and wherein said other seal member includes a material which swells upon contact with water so as to move the other seal member from the retracted mode to the expanded mode thereof.

14. The wellbore system of claim 1, wherein the tubular element has been radially expanded in the borehole.

* * * * *